US006644796B2

(12) United States Patent
Olsen

(10) Patent No.: US 6,644,796 B2
(45) Date of Patent: Nov. 11, 2003

(54) FLUID INTERCONNECT IN A REPLACEABLE INK RESERVOIR FOR PIGMENTED INK

(75) Inventor: David Olsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 176 days.

(21) Appl. No.: 09/747,241

(22) Filed: Dec. 22, 2000

(65) Prior Publication Data

US 2002/0080217 A1 Jun. 27, 2002

(51) Int. Cl.[7] ..... B41J 2/175
(52) U.S. Cl. ..... 347/93
(58) Field of Search ..... 347/93, 92, 86, 347/85

(56) References Cited

U.S. PATENT DOCUMENTS

| | | | | |
|---|---|---|---|---|
| 3,371,350 A | | 2/1968 | Sanderson et al. | |
| 4,509,062 A | | 4/1985 | Low et al. | |
| 4,558,326 A | | 12/1985 | Kimura et al. | |
| 4,920,362 A | | 4/1990 | Cowger | |
| 4,992,802 A | | 2/1991 | Dion et al. | |
| 5,085,698 A | | 2/1992 | Ma et al. | 106/20 |
| 5,367,328 A | | 11/1994 | Erickson | 347/7 |
| 5,369,429 A | | 11/1994 | Erickson | 347/7 |
| 5,409,134 A | | 4/1995 | Cowger et al. | 222/1 |
| 5,505,339 A | | 4/1996 | Cowger et al. | 222/105 |
| 5,552,815 A | | 9/1996 | Shimoda | 347/85 |
| 5,680,164 A | | 10/1997 | Miller et al. | |
| 5,700,315 A | | 12/1997 | Wenzel | 106/31.58 |
| 5,719,609 A | | 2/1998 | Hauck et al. | 347/85 |
| 5,724,082 A | | 3/1998 | Moynihan | 347/88 |
| 5,742,311 A | | 4/1998 | Koitabashi et al. | 347/86 |
| 5,777,646 A | | 7/1998 | Barinaga et al. | 347/86 |
| 5,852,459 A | | 12/1998 | Pawlowski, Jr. et al. | 347/86 |
| 5,900,890 A | | 5/1999 | Mitchell | 347/28 |
| 5,971,531 A | * | 10/1999 | Dietl et al. | 347/86 |
| 6,033,063 A | | 3/2000 | Tomikawa et al. | |
| 6,042,225 A | | 3/2000 | Altendorf et al. | |
| 6,082,852 A | * | 7/2000 | Soga et al. | 347/86 |
| 6,203,146 B1 | | 3/2001 | Pawlowksi, Jr. et al. | 347/85 |

FOREIGN PATENT DOCUMENTS

| | | | |
|---|---|---|---|
| EP | 0562717 A1 | 9/1993 | B41J/2/175 |
| EP | 0745482 A2 | 4/1995 | B41J/2/175 |
| EP | 0770490 A2 | 10/1995 | B41J/2/19 |
| EP | 0714778 A1 | 6/1996 | B41J/2/17 |
| EP | 0287098 A2 | 10/1998 | B41J/3/04 |
| GB | 2326845 A | 1/1999 | |
| JP | 62-161544 | 7/1987 | B41J/3/04 |
| JP | 07076094 | 3/1995 | B41J/2/175 |
| WO | WO 97/16315 | 5/1997 | B41J/2/175 |

OTHER PUBLICATIONS

EPO Search Report from related application 01310615.8–2304, dated May 7, 2002.

* cited by examiner

*Primary Examiner*—Judy Nguyen

(57) ABSTRACT

A replaceable ink reservoir for a printing system using pigmented ink. The ink reservoir includes a containment vessel, a body of reservoir material disposed in the vessel, a fluid interconnect opening formed in the vessel, and a screen disposed in the containment vessel and across the interconnect opening. The screen has a pore size small enough to prevent air passage at operational pressures and large enough to allow colorant particles dispersed in the ink carrier fluid to pass therethrough.

11 Claims, 7 Drawing Sheets

FIG. 5
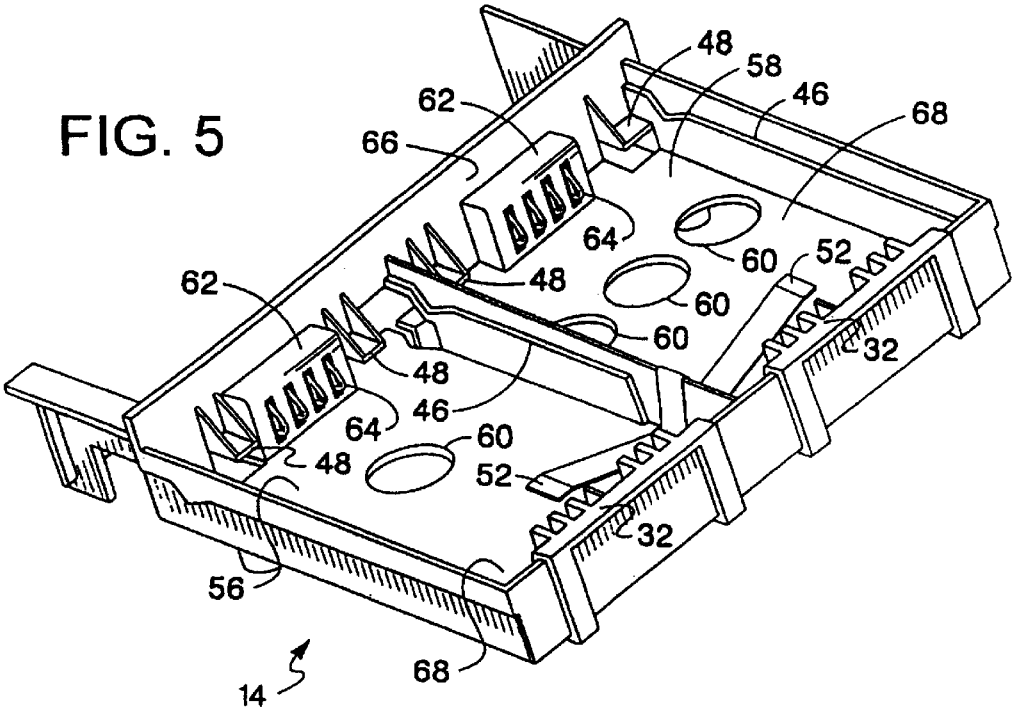
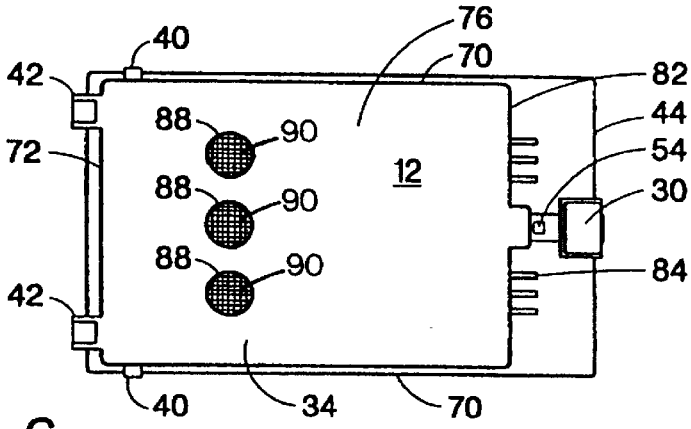
FIG. 6

FIG. 7
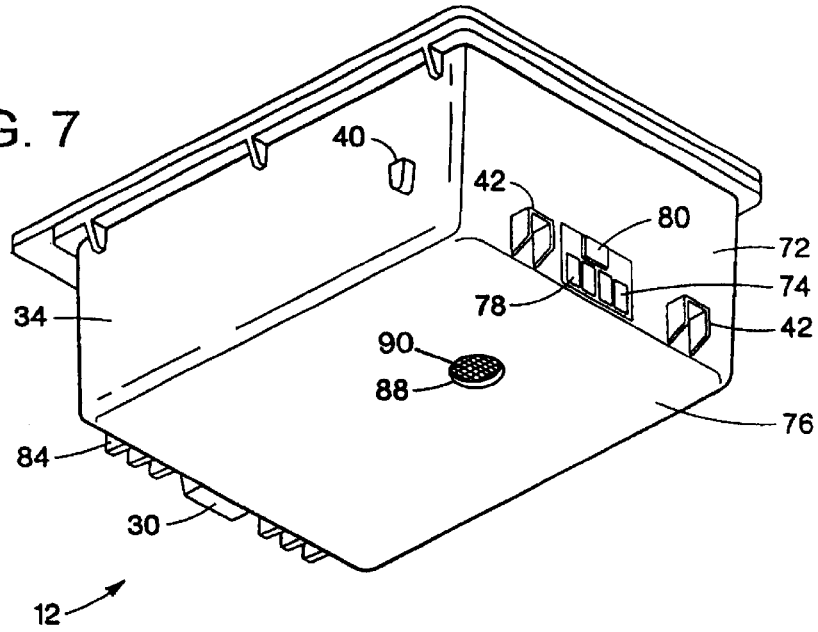
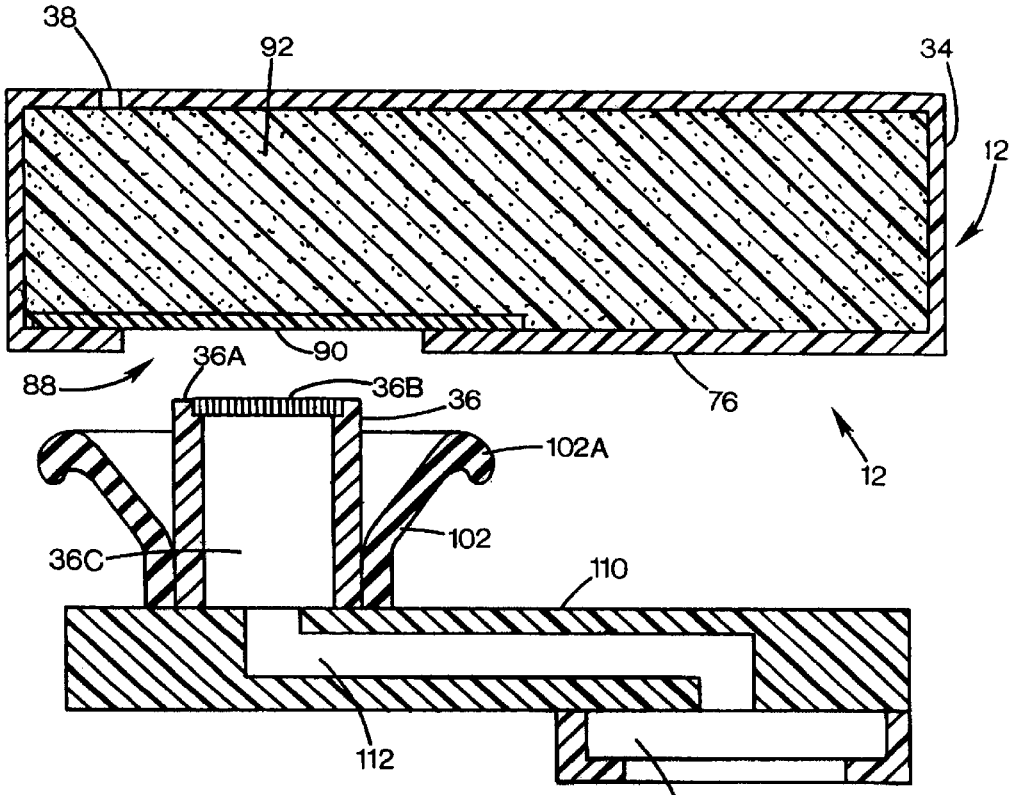
FIG. 8

FLUID INTERCONNECT IN A REPLACEABLE INK RESERVOIR FOR PIGMENTED INK

TECHNICAL FIELD OF THE INVENTION

The present invention relates to ink containers for providing ink to inkjet printers.

BACKGROUND OF THE INVENTION

The present invention relates to ink containers for providing ink to inkjet printers. Inkjet printers frequently make use of an inkjet printhead mounted on a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system not to move with the carriage.

For the case where the ink supply is not carried with the carriage, the ink supply can be in continuous fluid communication with the printhead by the use of a conduit to replenish the printhead continuously. Alternatively, the printhead can be intermittently connected with the ink supply by positioning the printhead proximate to a filling station that facilitates connection of the printhead to the ink supply.

For the case where the ink supply is carried with the carriage, the ink supply may be integral with the printhead, whereupon the entire printhead and ink supply is replaced when ink is exhausted. Alternatively, the ink supply can be carried with the carriage and be separately replaceable from the printhead. For the case where the ink supply is separately replaceable, the ink supply is replaced when exhausted, and the printhead is replaced at the end of printhead life. Regardless of where the ink supply is located within the printing system, it is critical that the ink supply provide a reliable supply of ink to the inkjet printhead.

In addition to providing ink to the inkjet printhead, the ink supply frequently provides additional functions within the printing system, such as maintaining a negative pressure, frequently referred to as a backpressure, within the ink supply and inkjet printhead. This negative pressure must be sufficient so that a head pressure associated with the ink supply is kept at a value that is lower than the atmospheric pressure to prevent leakage of ink from either the ink supply or the inkjet printhead frequently referred to as drooling. The ink supply is required to provide a negative pressure or back pressure over a wide range of temperatures and atmospheric pressures in which the inkjet printer experiences in storage and operation.

One negative pressure generation mechanism that has previously been used is a porous member, such as an ink absorbing member, which generates a capillary force. One such ink absorbing member is a reticulated polyurethane foam which is discussed in U.S. Pat. No. 4,771,295, entitled "Thermal Inkjet Pen Body Construction Having Improved Ink Storage and Feed Capability" to Baker, et al., issued Sep. 13, 1988, and assigned to the assignee of the present invention.

There is an ever present need for ink supplies which make use of low cost materials and are relatively easy to manufacture, thereby reducing ink supply cost that tends to reduce the per page printing costs. In addition, these ink containers should be volumetrically efficient to produce a relative compact ink supply for reducing the overall size of the printing system. In addition, these ink supplies should be capable of being made in different form factors so that the size of the printing system can be optimized. Finally, these ink supplies should be compatible with inks used in inkjet printing systems to prevent contamination of these inks. Contamination of the ink tends to reduce the life of the inkjet printhead as well as reduce the print quality.

Prior solutions for simple, detachable ink reservoirs have been limited to non-pigmented inks, where drying and clogging concerns are much less. Application of pigmented ink, known for better print and image quality characteristics, to existing designs fail due to drying and clogging. As opposed to dye-based ink, pigmented ink has very small solid particles of colorant dispersed within a carrier fluid. When pigmented ink dries, the solid particles fall out of suspension and solidify on any solid surface. Once the particles become bonded to solid surfaces, they do not re-dissolve in the presence of fresh ink. Multiple cycles of drying will continue to build up solid deposits until clogging occurs.

SUMMARY OF THE INVENTION

This invention provides a versatile implementation of a fluid interconnect that solves drying and crusting problems associated with pigmented inks by moving the clogging point into the reservoir where it is protected from short term drying and is automatically replaced when a new reservoir is installed.

In a conventional design used for non-pigmented inks, the ink delivery system downstream of the reservoir is considered more permanent and expensive to replace. Pigmented inks placed in these designs often clog due to drying and crusting at locations where prolonged air exposure can occur. By moving the critical area where clogs occur into the reservoir, clogs are less likely to occur and before build up blocks ink passage, the reservoir is thrown away and replaced with a fresh one.

This invention provides multiple options of implementing a robust fluid interconnect, enabling a variety of manufacturing options, and allowing more design freedom in the fluid interconnected tower to prevent clogs.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5 illustrates in isolation a receiving station for receiving one or more replaceable ink containers of the present invention.

FIG. 6 is a bottom view of a three-color replaceable ink container of the present invention shown in isolation.

FIG. 7 is a perspective view of a single color replaceable ink container of the present invention.

FIG. 8 is a cross-sectional view taken along line 8—8 of FIG. 4, illustrating in further detail the ink container, comprising the reservoir portion or containment vessel, with the reservoir material disposed therein.

DETAILED DESCRIPTION OF THE PREFERRED EMBODIMENTS

Figure 1:
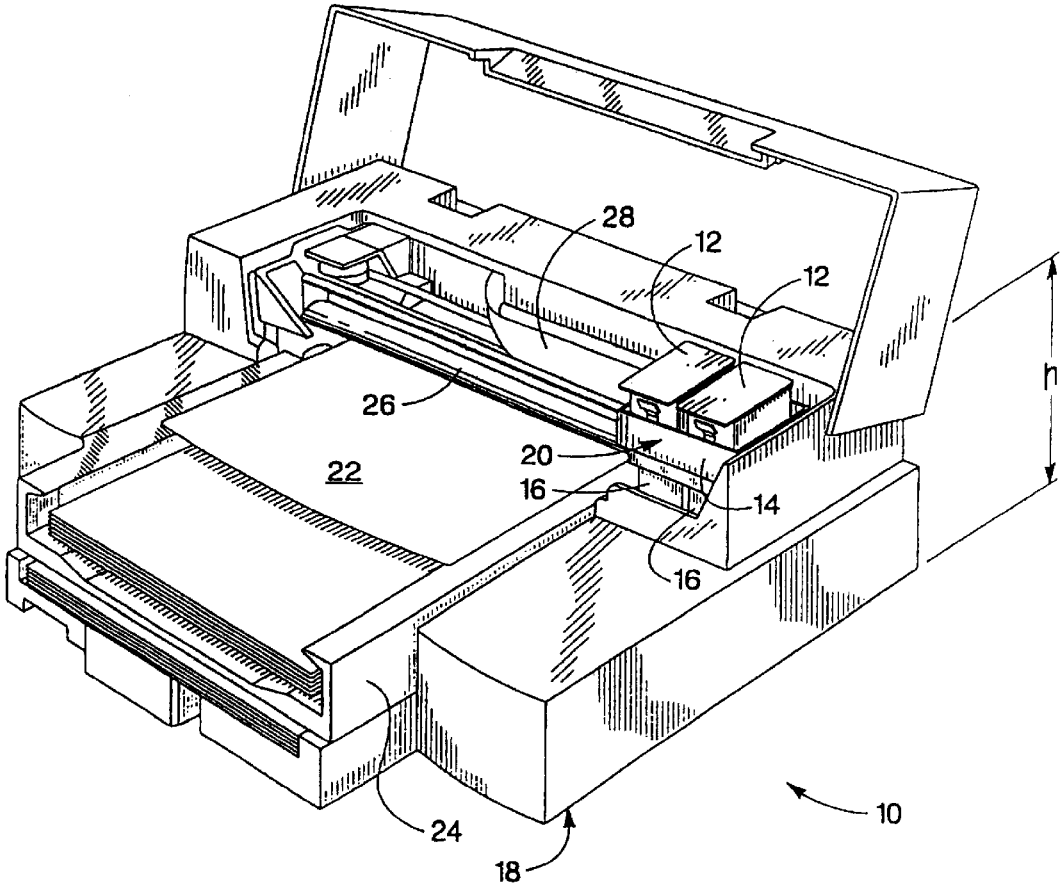
FIG. 1 is one exemplary embodiment of an ink jet printing system of the present invention shown with a cover opened to show a plurality of replaceable ink containers of the present invention.

FIG. 1 is a perspective view of one exemplary embodiment of a printing system 10, shown with its cover open, that includes at least one replaceable ink container 12 that is installed in a receiving station 14. With the replaceable ink container 12 properly installed into the receiving station 14, ink is provided from the replaceable ink container 12 to at least one ink jet print cartridge 16. The ink jet print cartridge 16 includes a small ink reservoir and an ink jet printhead 17 (FIG. 2), that is responsive to activation signals from a printer portion 18 to deposit ink on print media. As ink is ejected from the printhead 17, the print cartridge 16 is replenished with ink from the ink container 12.

In an illustratative embodiment, the replaceable ink container 12, the receiving station 14, and the ink jet print cartridge 16 are each part of a scanning print carriage 20 that is moved relative to a print media 22 to accomplish printing. Alternatively, the ink jet print cartridge is fixed and the print media is moved past the print cartridge to accomplish printing. The printer portion 18 includes a media tray for receiving print media 22. As print media 22 is stepped through the print zone, the scanning carriage moves the print cartridge relative to the print media 22. The printer portion 18 selectively activates the print cartridge 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the print cartridge 16 by means of an electrical link such as a ribbon cable 28.

A method and apparatus is provided for inserting the ink container 12 into the receiving station 14 such that the ink container 12 forms proper fluidic and electrical interconnect with the printer portion 18. The fluidic interconnection allows a supply of ink within the replaceable ink container 12 to be fluidically coupled to the print cartridge 16 for providing a source of ink to the print cartridge 16. The electrical interconnection allows information to be passed between the replaceable ink container 12 and the printer portion 18. Information passed between the replaceable ink container 12 and the printer portion 18 can include information related to the compatibility of replaceable ink container 12 with printer portion 18 and operation status information such as the ink level information, to name some examples.

Figure 2:
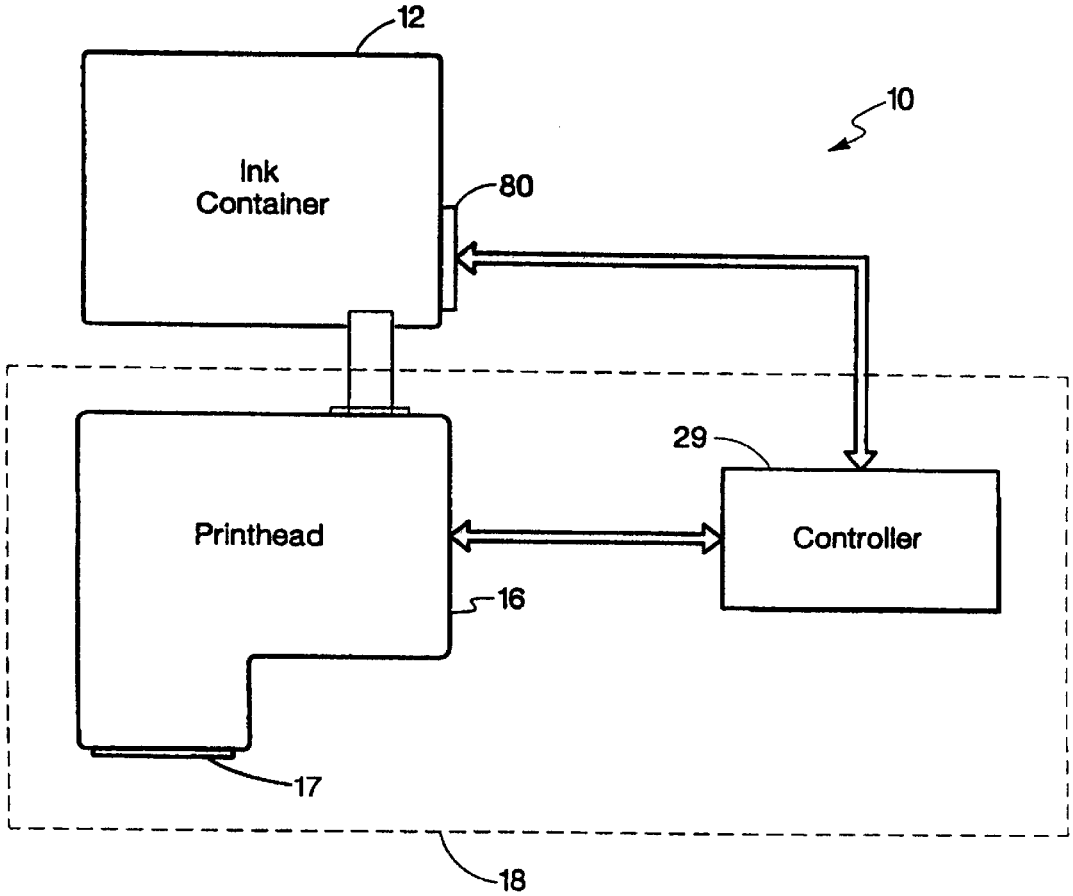
FIG. 2 is a schematic representation of the inkjet printing system shown in FIG. 1.

FIG. 2 is a simplified schematic representation of the inkjet printing system 10 shown in FIG. 1. FIG. 2 is simplified to illustrate a single print cartridge 16 connected to a single ink container 12. The inkjet printing system 10 includes the printer portion 18 and the ink container 12, which is configured to be received by the printer portion 18. The printer portion 18 includes the inkjet print cartridge 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the print cartridge 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the print cartridge 16 and the controller 29 for activating the print cartridge to selectively deposit ink on print media. In addition, the controller 29 controls the relative movement of the print cartridge 16 and print media. The controller 29 performs additional functions such as controlling the transfer of information between the printing system 10 and a host device such as a host computer (not shown).

Figure 3:
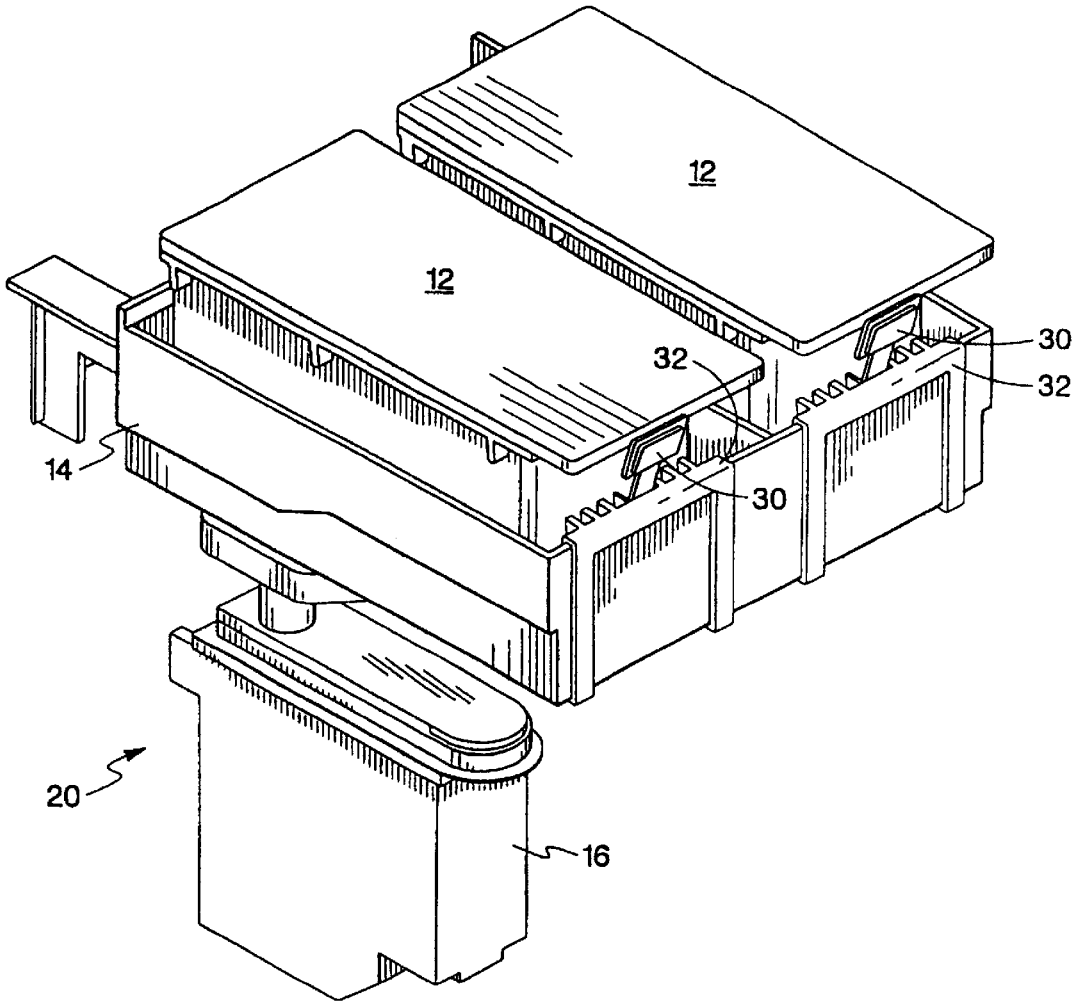
FIG. 3 is a greatly enlarged perspective view of a portion of a scanning carriage showing the replaceable ink containers of the present invention positioned in a receiving station that provides fluid communication between the replaceable ink containers and one or more printhead.

FIG. 3 is a perspective view of a portion of the scanning carriage 20 showing a pair of replaceable ink containers 12 properly installed in the receiving station 14. An inkjet print cartridge 16 is in fluid communication with the receiving station 14. In an exemplary embodiment, the inkjet printing system 10 includes a tricolor ink container containing three separate ink colors and a second ink container containing a single ink color. In this embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

In an exemplary embodiment, four inkjet print printheads 17, one mounted to a cartridge for printing black ink, and three mounted to a tri-color cartridge for printing cyan, magenta and yellow, are each fluidically coupled to the receiving station 14. In this exemplary embodiment, each of the four printheads is fluidically coupled to one of the four colored inks contained in the replaceable ink containers. Thus, the cyan, magenta, yellow and black printheads 17 are each coupled to their corresponding cyan, magenta, yellow and black ink supplies, respectively. Other configurations which make use of fewer printheads than four are also possible. For example, the print cartridges 16 can be configured to print more than one ink color by properly partitioning the printhead 17 to allow a first ink color to be provided to a first group of ink nozzles and a second ink color to be provided to a second group of ink nozzles, with the second group of ink nozzles different from the first group. In this manner, a single print cartridge 16 can be used to print more than one ink color allowing fewer than four print cartridges 16 to accomplish four-color printing.

In another exemplary embodiment, four print cartridges each with a printhead can be employed, with four replaceable ink containers, and with each cartridge fluidically coupled to one of the four colored inks contained in the replaceable ink containers. Thus, for this alternate embodiment, the cyan, magenta, yellow and black printheads are each coupled to their corresponding cyan, magenta, yellow and black ink supplies, respectively.

The scanning carriage portion 20 shown in FIG. 3 is shown fluidically coupled to a single print cartridge 16 for simplicity. Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features 10 on the replaceable ink container 12 interact with the keys 32 on the receiving station 14 to ensure that the replaceable ink container 12 is compatible with the receiving station 14.

Figure 4:
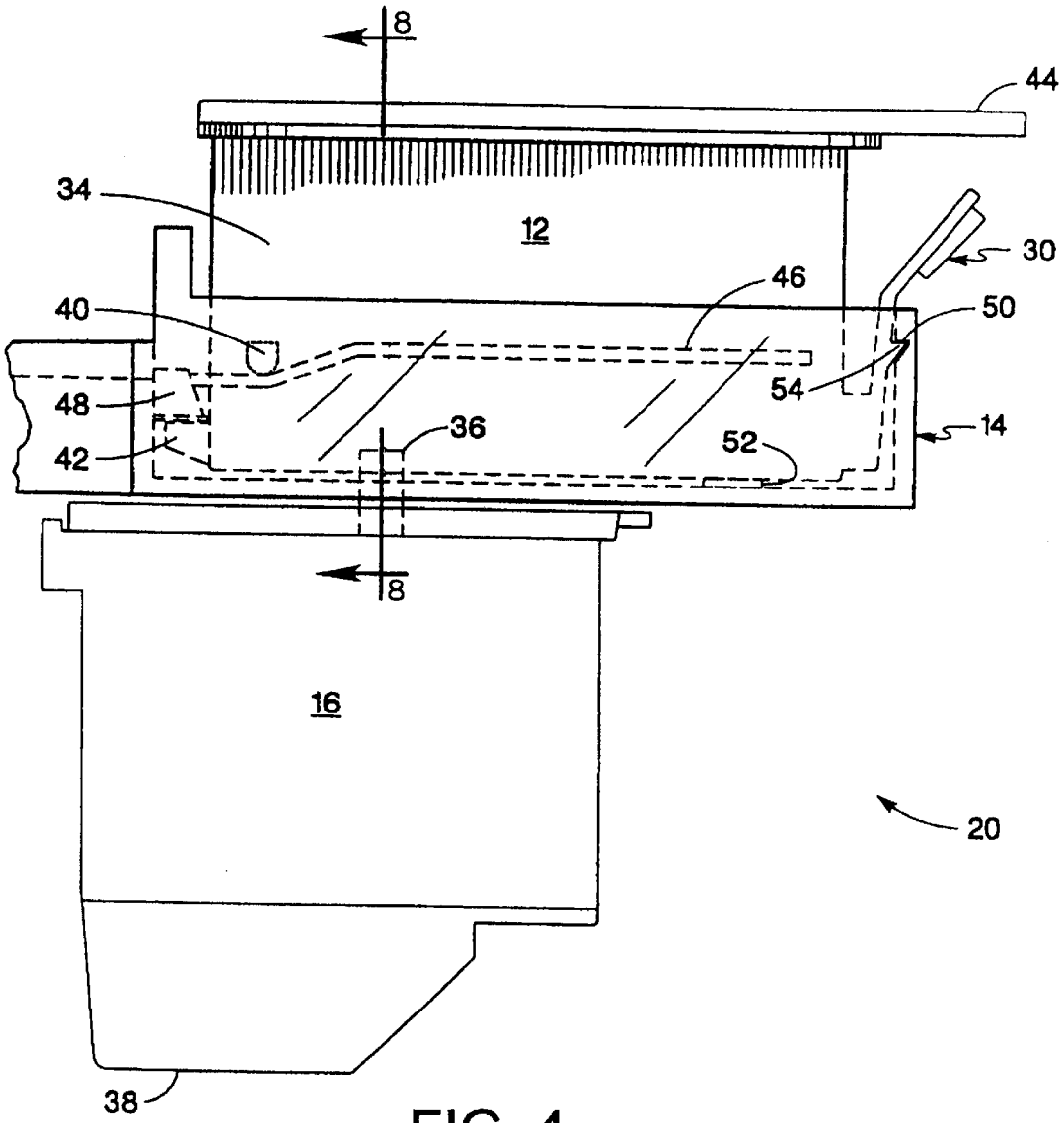
FIG. 4 is a side plan view of a portion of the scanning carriage.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the print cartridge 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment the monochrome replaceable ink container 12 is a single ink reservoir 34 for containing ink of a single color.

In the preferred embodiment, the reservoir 34 has a capillary storage member 92 (FIGS. 8–9) disposed therein. The capillary storage member 92 is a porous member having sufficient capillarity to retain ink to prevent ink leakage from the reservoir 34 during insertion and removal of the ink container 12 from the printing system 10. This capillary force is sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in U.S. patent application entitled "Ink Reservoir for an Inkjet Printer" attorney docket 10991407 filed on Oct. 29, 1999, Ser. No. 09/430,400, assigned to the assignee of the present invention and incorporated herein by reference. Other types of capillary material could alternatively be employed, such as foam.

Once the ink container 12 is properly installed into the receiving station 14, the ink container 12 is fluidically coupled to the print cartridge 16 by way of fluid interconnect 36. Upon activation of the print cartridge 16, ink is ejected from the printhead 17 producing a negative gauge pressure, sometimes referred to as backpressure, within the print cartridge 16. This negative gauge pressure within the print cartridge 16 is sufficient to overcome the capillary force resulting from the capillary member disposed within the ink reservoir 34. Ink is drawn by this backpressure from the replaceable ink container 12 to the printhead 17. In this manner, the print cartridge 17 is replenished with ink provided by the replaceable ink container 12.

The fluid interconnect 36 is preferably an upstanding ink pipe that extends upwardly into the ink container 12 and downwardly to the inkjet print cartridge 16. The fluid interconnect 36 is shown greatly simplified in FIG. 4. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the print cartridge 16. The ink container 12 is properly positioned within the receiving station 14 such that proper compression of the capillary member is accomplished when the ink container 12 is inserted into the receiving station. Proper compression of the capillary member establishes a reliable flow of ink from the ink container 12 to the print cartridge 16. In accordance with an aspect of the invention, the ink container 12 includes a screen 90 (FIGS. 6–9) disposed across the fluid outlet 88. The fluid interconnect 36 engages the screen 90 when inserted into the fluid outlet 88. This feature of the invention is described in further detail below.

The replaceable ink container 12 further includes a guide feature 40, an engagement feature 42, a handle 44 and a latch feature 30 that allow the ink container 12 to be inserted into the receiving station 14 to achieve reliable fluid interconnection with the print cartridge 16 as well as form reliable electrical interconnection between the replaceable ink container 12 and the scanning carriage 20.

In this exemplary embodiment, the receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14.

FIG. 5 is a front perspective view of the ink receiving station 14 shown in isolation. The receiving station 14 shown in FIG. 5 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container 12 containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving each of the uptight fluid interconnects 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts 64 are an arrangement of four spring-loaded electrical contacts with proper installation of the replaceable ink container 12 into the corresponding bay of the receiving station 14.

FIG. 6 is a bottom view of a three-color replaceable ink container 12 of the present invention shown in isolation. FIG. 7 is a perspective view of a single color replaceable ink container of the present invention. The replaceable ink container 12 includes a pair of outwardly projecting guide rail engagement features 40. In the preferred embodiment, each of these guide rail engagement features 40 extend outwardly in a direction orthogonal to uptight side 70 of the replaceable ink container 12. The engagement features 42 extend outwardly from a front surface or leading edge of the ink container 72. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Once the ink container 12 is installed into the printing system 10 and fluidically coupled to the printhead by way of fluid interconnect 36, the capillary storage member 92 should allow ink to flow from the ink container 12 to the ink jet printhead 17. As the printhead 17 ejects ink, a negative gauge pressure, sometimes referred to as a back pressure, is created in the print cartridge 16. This negative gauge pressure within the print cartridge 16 should be sufficient to overcome the capillary force retaining ink within the capillary member 92, thereby allowing ink to flow from the ink container 12 into the print cartridge 16 until equilibrium is reached. Once equilibrium is reached and the gauge pressure within the print cartridge 16 is equal to the capillary force retaining ink within the ink container 12, ink no longer flows from the ink container 12 to the print cartridge 16. The gauge pressure in the print cartridge 16 will generally depend on the rate of ink ejection from the printhead 17. As the printing rate or ink ejection rate increases, the gauge pressure within the printhead will become more negative, causing ink to flow at a higher rate to the printhead 17 from the ink container 12.

In one preferred inkjet printing system 10 the print cartridge 16 produces a maximum backpressure that is equal to 10 inches of water or a negative gauge pressure that is equal to 10 inches of water. The maximum backpressure will depend on the particular printhead used in the system. As the backpressure increases, the size of the ink droplets ejected by the printhead 17 becomes smaller, leading eventually to print quality problems, and ultimately to depriming, when air is pulled through the printhead nozzles, allowing ink to drool out of the nozzles. The smaller the nozzle size, the higher will be the backpressure tolerated by the printhead before the print quality issues are typically encountered. Thus, for an exemplary form of thermal inkjet printhead, depriming of a black ink printhead typically occurs at a backpressure of about 15 inches of water, and print quality issues arise at a backpressure of about 8 inches of water. For an exemplary color ink printhead, which typically has smaller nozzles than a black ink printhead, depriming occurs at a backpressure about 20–22 inches of water, and print quality issues arise at a backpressure of about 12 inches of water.

The print cartridge 16 can have a regulation device included therein for compensation for environmental changes such as temperature and pressure variations. An exemplary suitable regulation device is described in U.S. Pat. No. 5,975,686, although other regulation devices could alternatively be employed. If these variations are not compensated for, then uncontrolled leaking of ink from the printhead 17 can occur. In some configurations of the printing system, the print cartridge 17 does not include a regulation device; instead the capillary member is used to maintain a negative back pressure in the print cartridge over normal pressure and temperature excursions. The capillary force of the capillary member 92 tends to pull ink back to the capillary member, thereby creating a slight negative back pressure within the print cartridge 16. This slightly negative back pressure tends to prevent ink from leaking or drooling from the ejection portion 30 during changes in atmospheric conditions such as pressure changes and temperature changes. The capillary member 40 should provide sufficient back pressure or negative gauge pressure in the printhead 24 to prevent drooling during normal storage and operating conditions.

The embodiment in FIG. 2 depicts an ink container 12 and a printhead 24 that are each separately replaceable. The ink container 12 is replaced when exhausted and the printhead 24 is replaced at end of life. The method and apparatus of the present invention is applicable to inkjet printing systems 10 having other configurations than those shown in FIG. 2. For example, the ink container 12 and the printhead 24 can be integrated into a single print cartridge. The print cartridge which includes the ink container 12 and the printhead 24 is then replaced when ink within the cartridge is exhausted.

In an exemplary embodiment, each of the height, width, and length dimensions of the ink container 12 are all greater than one inch to provide a high capacity ink container 12.

FIG. 8 is a cross-sectional view taken along line 8—8 of FIG. 4, illustrating in further detail the ink container 12, comprising the reservoir portion or containment vessel 34, with the reservoir material 92 disposed therein. In accordance with an aspect of the invention, a screen (mesh) 90 is disposed across the fluid outlet 88, serving as a fluid interconnect (FI) opening for ink extraction from the container 12. Also shown is the FI tower 34 through which ink is extracted. In previous designs, a screen would typically be attached to the top of the FI tower and remain there when the reservoir 12 was removed from the FI tower. When this occurred, the screen on the FI tower would dry up within a day, crust over and block further ink flow. This would result in a service call to replace the clogged FI tower. With the screen 50 disposed in the reservoir 12, there is a large quantity of ink within the reservoir material 92 to keep the screen from drying out if it is exposed to air. As a worst case, if even the reservoir dries out, the reservoir 12 is just discarded, and the FI tower is still open for connection to another container.

The screen 90 can be made of any of a variety of materials, including for example, polymers such as polyester and nylon, or, metal meshes such as a stainless steel. The individual fibers of the mesh are preferably woven to produce a relatively uniform pore size small enough to prevent air passage at operation pressures, yet large enough to pass the suspended particles constituting the pigmented ink. In an exemplary pigmented ink, the suspended particles have a nominal largest size dimension in the range of 90 to 120 nanometers. Exemplary pigmented inks suitable for the purpose are described in U.S. Pat. No. 5,085,698. An exemplary preferred embodiment of the screen has a nominal 40 micron pore size. Smaller pore sizes can be used but can restrict flow rates in some applications. Thus, the pore size should be selected to be large enough so that the flow rate is not restricted sufficiently that the backpressure does not exceed the upper limit described above. The bubble formation is dependent on the surface tension and viscosity of the ink, and so the pore size for a particular application is dependent on the ink parameters and the printhead parameters, including the nozzle size. A suitable pore size for a given application can be determined empirically.

The screen can be any of a number of weave designs; an open weave has been found to work well. Even random oriented fibers have been tested with success.

Methods of retaining the screen 90 in place in the ink container 12 range from just laying in the screen within the vessel 34 prior to placing the reservoir material in the vessel, to bonding or gluing the screen to the vessel bottom wall 34A. Alternatively, a screen can be bonded or molded into a washer that is dropped into the vessel and aligned over the FI opening 88. The particular mesh material and attachment technique can be chosen to optimize material and manufacturing costs. A preferred embodiment employs a polyester screen mesh that is heat bonded to the reservoir bottom wall 76 prior to inserting the reservoir material into the vessel.

Figure 9:
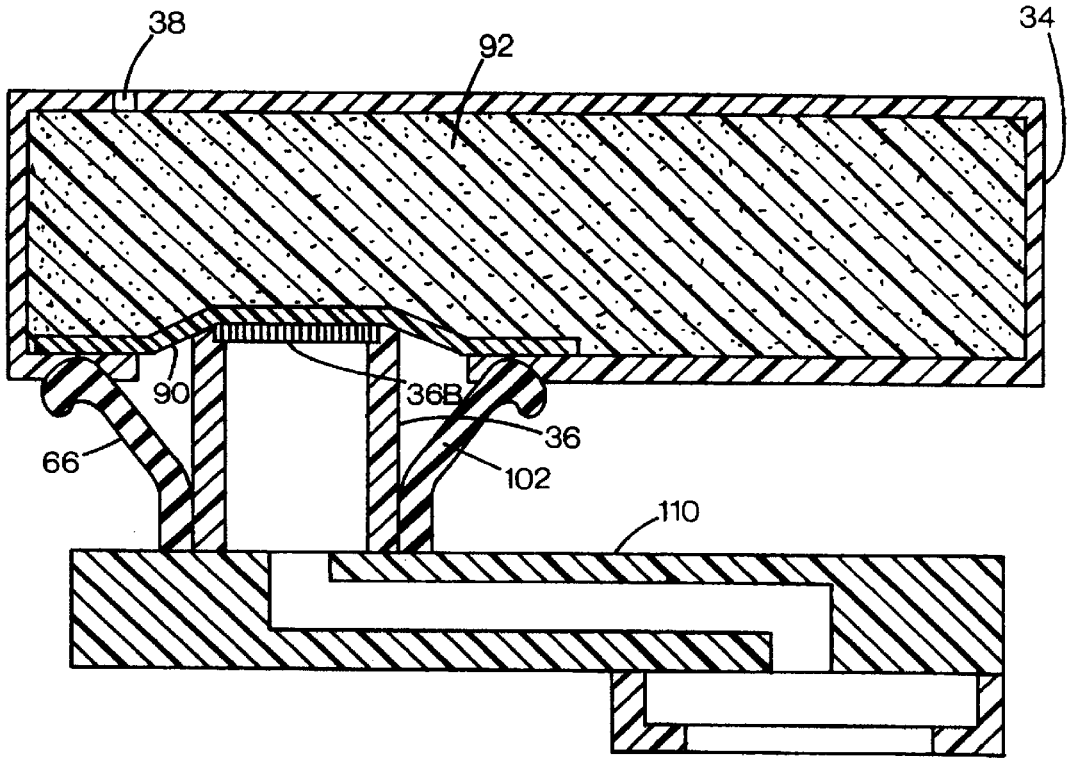
FIG. 9 is a cross-sectional view, similar to FIG. 8 but showing the fluid interconnect in fluidic engagement with the ink container.

A feature of this embodiment is that, when the FI tower 36 is engaged with the container 12, the screen 90 makes contact with the reservoir material 92, and forms a seal to the top surface 36A of the FI tower (FIG. 9). This prevents air from entering the system until all the ink is extracted from the reservoir. As shown in FIG. 8, this embodiment of the FI tower 36 is connected to a manifold 70 having a fluid channel 112 formed therein and passing between the FI channel 36C and a fluid connection 114 to the print cartridge 16. A fluid interconnect screen 36B is positioned across the inlet of the FI 36. The screen 36B has a larger mesh opening size than that of screen 90, e.g. 100 microns to 200 microns, to avoid clogging from dried ink pigments under typical use conditions. Because of the larger mesh sizing, a low bubble pressure, e.g. on the order of 3 inches of water, will result in passage of air bubbles. Thus, the screen 36B will not provide the air bubble blocking performance needed for the system, and so screen 90 is used to provide this bubble blocking function. The screen 36B could be omitted for some applications, and indeed is not needed when the ink container and the fluid interconnect are mated as shown in FIG. 9. The screen 36B does provide a function of preventing ink from drooling out of the fluid interconnect manifold when the ink supply 12 is removed, even if the fluid interconnect is tipped from the vertical for pen servicing.

The FI further includes a humidor seal structure 102, formed of an elastomeric material such as rubber, Ethylene Propylene Diene Monomer (EPDM), butyl, or a combination of the latter two. This seal structure has a peripheral lip 102A with a sufficient diameter to engage against the bottom wall 76 around the periphery of the fluid outlet 88, and thereby seal the outlet opening 88 from the outside atmosphere. An exemplary form of the seal with a spring is described in co-pending application Ser. No. 09/651,682, filed Aug. 30, 2000, LONG-LIFE SPRING-BACKED FLUID INTERCONNECT SEAL.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink supply system for an inkjet printing system with an inkjet print cartridge, comprising:

a replaceable ink container for holding a supply of pigmented liquid ink, the ink container comprising a containment vessel, the containment vessel having an interconnect opening;

an outlet screen disposed in the containment vessel and across the interconnect opening, the outlet screen having a pore size small enough to prevent air passage at operational pressures and large enough to allow said dispersed colorant particles to pass therethrough;

a body of reservoir material disposed in the containment vessel, the body of reservoir material having a region adjacent to and in contact with the outlet screen;

a receiving station for mounting the ink container;

a fluid interconnect structure for establishing a fluid path from the ink container to the ink jet cartridge when the ink container is installed in the receiving station, the fluid interconnect structure including an interconnect tower having a distal end with a fluid interconnect inlet port and an inlet screen across the fluid interconnect inlet port, the inlet screen having a pore size larger than the pore size of the outlet screen and large enough to avoid clogging from dried ink pigments under typical use conditions.

2. The system of claim 1, wherein the body of reservoir material includes a capillary storage member for storing ink within the reservoir under negative pressure.

3. The system of claim 1, wherein the containment vessel has a bottom wall and a top wall, and wherein the fluid interconnect opening is disposed in the bottom wall, and a vent opening is formed in the top wall.

4. The system of claim 1, further comprising a supply of pigmented liquid ink disposed in the containment vessel.

5. The system of claim 1, wherein the outlet screen has a nominal pore size of 40 microns.

6. The system of claim 1, wherein the inlet screen pore size is small enough to prevent ink from drooling out from the fluid interconnect inlet port when the ink supply is removed.

7. The system of claim 1, wherein the inlet screen has a nominal pore size at least twice as large as a nominal pore size of the outlet screen.

8. The system of claim 1, wherein the inlet screen has a nominal pore size of at least 100 microns.

9. The system of claim 1, wherein the inlet screen has a nominal pore size within a range from 100 microns to 200 microns.

10. The system of claim 1, wherein the outlet screen is fabricated of a polyester mesh.

11. The system of claim 1 wherein the containment vessel comprises a wall in which the interconnect opening is defined, and said screen is bonded to said wall in a peripheral region about the interconnect opening.

* * * * *